United States Patent [19]

Dudziak et al.

[11] 4,372,201

[45] Feb. 8, 1983

[54] DEVICE FOR PRODUCING A BUNDLE OF PAPER SHEETS

[75] Inventors: Ernst Dudziak, Harsewinkel; Gerd-Georg Kwauka, Gutersloh; Arthur Plate, Lubbecke; Hermann Lübeck, Espelkamp-Frotheim, all of Fed. Rep. of Germany

[73] Assignee: Reinhard Mohn G.m.b.H., Gutersloh, Fed. Rep. of Germany

[21] Appl. No.: 278,376

[22] Filed: Jun. 29, 1981

Related U.S. Application Data

[62] Division of Ser. No. 963,125, Nov. 22, 1978, Pat. No. 4,311,090.

[51] Int. Cl.[3] ..... B65B 13/02

[52] U.S. Cl. ..... 100/7; 100/215; 271/215; 414/43

[58] Field of Search ..... 100/3, 7, 215, 26; 271/215, 218, 220, 221, 3.1; 414/43, 90, 98, 907

[56] References Cited

U.S. PATENT DOCUMENTS 2,933,314 4/1960 Stobb ..... 100/3 UX 3,822,793 7/1974 Stobb ..... 414/907 X 3,825,134 7/1974 Stobb ..... 414/43 X

*Primary Examiner*—Billy J. Wilhite

*Attorney, Agent, or Firm*—Silverman, Cass & Singer, Ltd.

[57] ABSTRACT

A device for producing a bundle from an overlapping sheet-by-sheet stream of folded printed sheets on a slope where the stream is initially conveyed to an inclined moving stacking table having a base, in a free fall delivery, to form a stack on the base and inclined toward the vertical. The stacking table is carried on a circulating conveyor and is moved downward in an inclined condition to receive the sheets. The circulating conveyor is provided with a followup transporter following a common path with the base and moves faster than the base. The followup transporter thus engages the top of the stack to compress same during formation thereof. A tension band arrangement effects jogging of the sheets on an inclined slope of 10° to 60° in the conveying direction so that each sheet slides toward the inclined slope under its own weight and/or by the push of the following sheet.

45 Claims, 15 Drawing Figures

FIG. 9
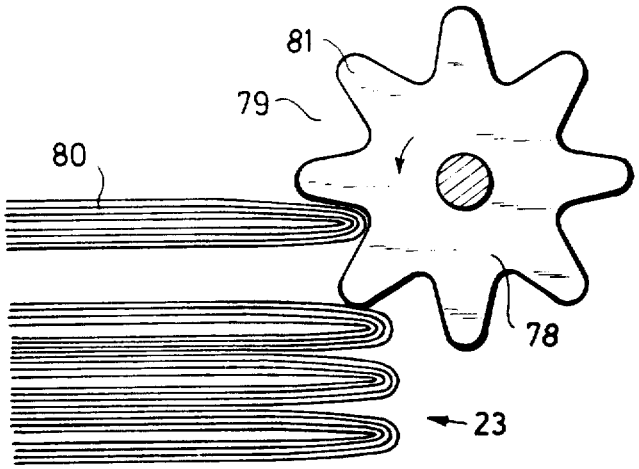
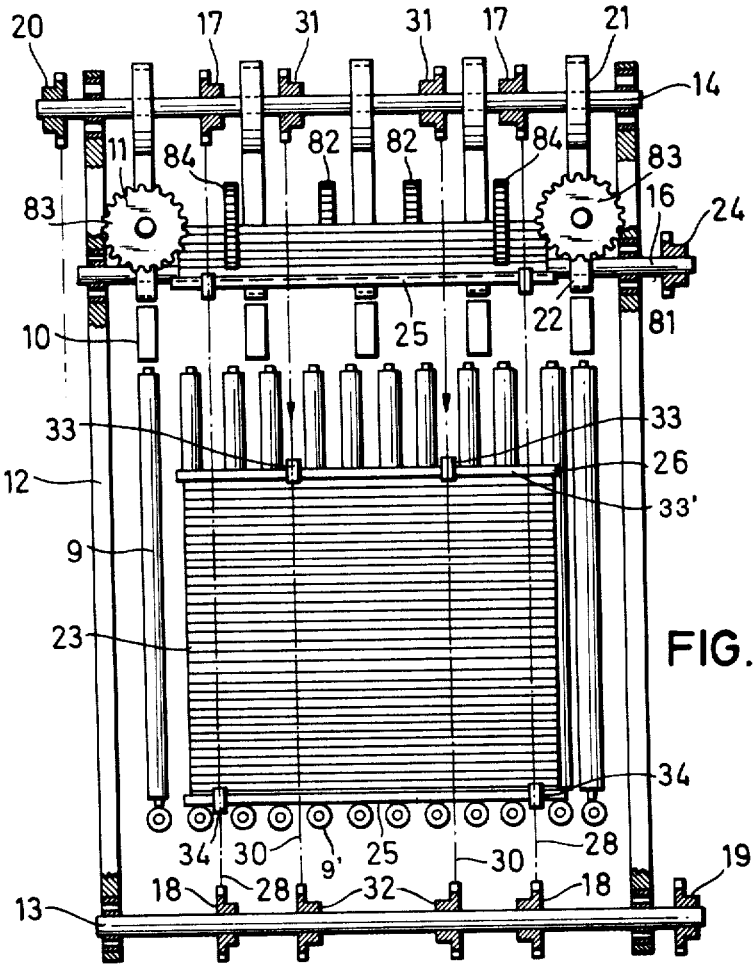
FIG. 10

DEVICE FOR PRODUCING A BUNDLE OF PAPER SHEETS

This is a division of application Ser. No. 963,125, filed Nov. 22, 1978, now U.S. Pat. No. 4,311,090.

BACKGROUND OF THE INVENTION

The invention relates generally to a device for producing a bundle of paper sheets, especially of folded printed sheets.

As a rule, sheets are delivered by a rotary machine in an overlapping sheet-by-sheet stream. In order to make the flow of material between the rotary machine and, for example, a bookbinding machine, more economical, discrete stacks are formed from the folded sheets of the sheet-by-sheet stream, which stacks are strapped into bundles. After intermediate storing, the bundles are delivered to the bookbindery for further processing. For the purposes of this description, "stacks" consist of signatures while the bundle represents a strapped or banded stack.

In a well-known device, columns are formed from the sheet-by-sheet stream by means of a hold-back mechanism. The columns are moved from a horizontal transport position vertically downward toward a conveyor belt system running horizontally. The paper sheets of the columns, which stand vertical and reach the conveyor belt system, are jogged by means of conveyor belts and a contact a pressure band between two spacing elements and are gathered in series; here the spacing elements can support guard plates. The formation of columns should produce a gap which enables a spacing element to swing thereinto to define the end of the series. The gathered series is moved upward, gripped and compressed, transported laterally into a banding station and provided with a bundling strip in order to form the bundles.

This well-known device requires a large number of machine elements and very much space. Especially the vertical position of the sheets causes considerable disadvantages for the gathering operation. For instance, the paper sheets bulge outward close to the spacing elements so that it becomes impossible to slide in the guard plates, which are supposed to protect the bundled bundles during the transport and the storing for further processing. This problem can be met only by means of an expensive additional device. Aside from the described disadvantages, the conveyor belts for moving the sheet-by-sheet stream cause friction at the gathering spot especially in the zone of transfer to the conveyor belt running horizontally; such friction leading to a smearing of the printing color and perhaps destruction of the sheet.

SUMMARY OF THE INVENTION

A device for producing a bundle or banded stack of sheets where the sheets are guided in an overlapping sheet-by-sheet stream and gathered into a stack along a slope inclined toward the vertical against the conveying direction while the sheets move downward on a support bearing on a slope, the sheets being jogged during formation of the stack. The gathered sheets subsequently move laterally, a guard plate placed on the last sheet and the stack compressed. A bundling band is provided in order to form the bundle.

BRIEF DESCRIPTION OF THE DRAWINGS

FIG. 9 shows schematically a part of the toothed wheel with one layer, and

FIG. 10 shows schematically the arrangement of the toothed wheels on the stacking table.

DESCRIPTION OF PREFERRED EMBODIMENTS

Figure 1:
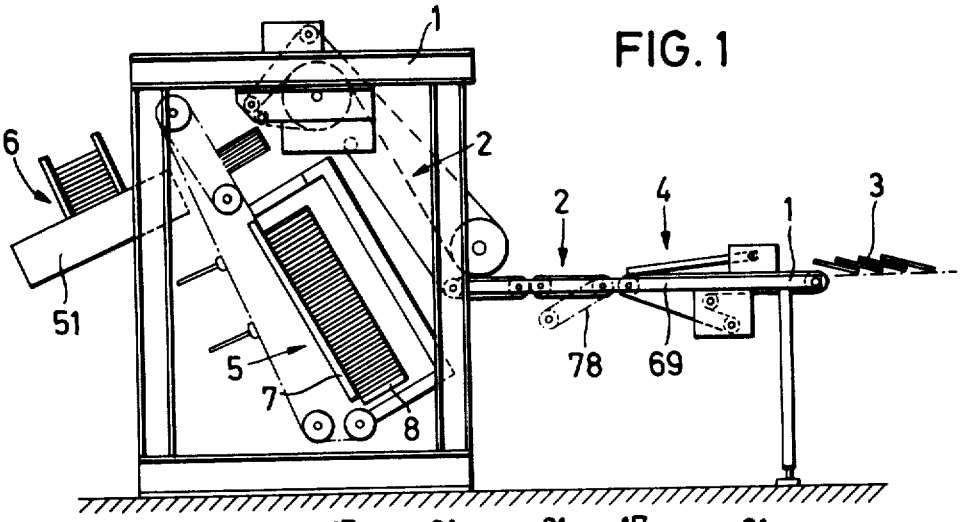
FIG. 1 shows a lateral view of the device.
Figure 3:
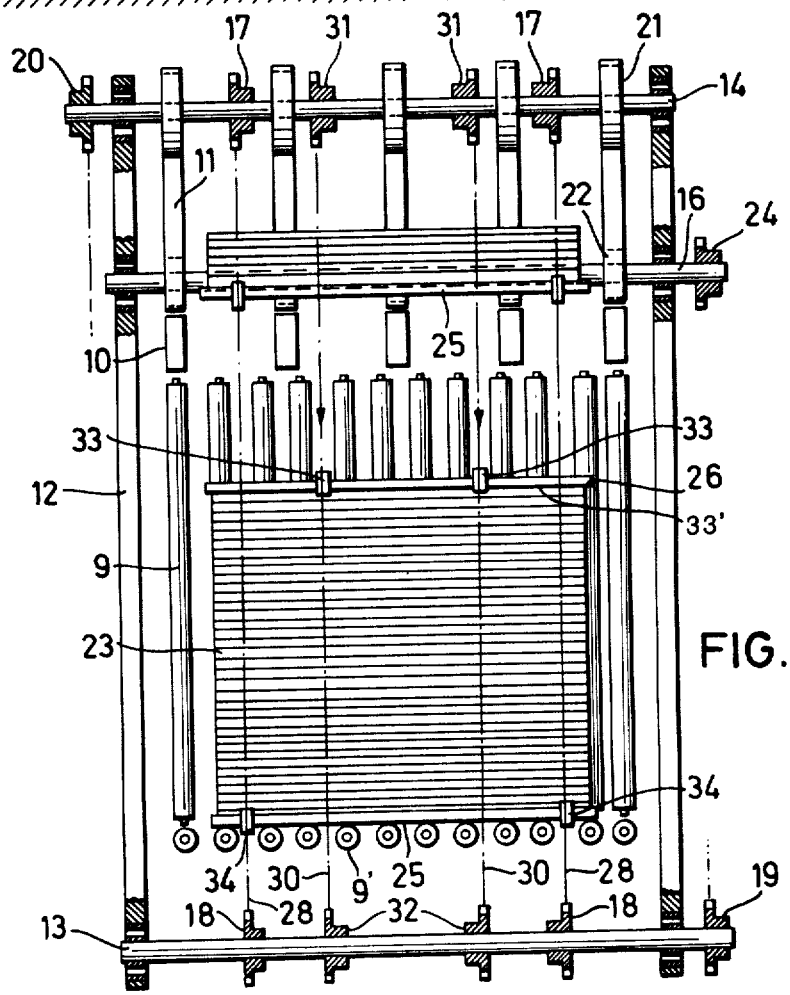
FIG. 3 shows a front view of the drive system of the transporters.

The device embodying the invention is illustrated in FIG. 1 as an automatic bundling machine for producing bundles from folded sheets and comprises essentially a machine frame 1, in which the means of conveyance of the overlapping sheet-by-sheet stream 3, the brake 4 for the sheet-by-sheet stream, the stacking table 5 and the feeding station 6 for the guard plates are arranged in a suitable manner (not shown).

The stacking table 5 is inclined in the conveying direction relative to the overlapping sheet-by-sheet stream. The table 5 has a back wall 7 inclined by about 60° toward the vertical and a bottom 8 at a right angle thereto. The bottom 8 preferably is designed so that its angular position to the back wall 7 can be adjusted relative to the vertical such as by being pivotally mounted relative to the machine frame 1 by means not shown. Thereby especially the formation of the building-block-shaped stack can be assisted. This change can take place during the stacking. The inclination of the stacking table is changeable. Back wall 7 and the bottom 8 preferably are each comprised of a plurality of rollers. The back wall 7 is comprised of a plurality of generally upright rollers 9 and the bottom 8 is comprised of generally horizontally oriented rollers 9'. The rollers 9 and 9' are all operatively connected so as to be driven in a common direction of rotation in a manner known per se and are arranged grate-like, parallel one next to the other, moving the bundle 23 in the transverse direction for conveying. In extension of the rollers of the back wall upward, short metal glide plates 10 are arranged stationary and aligned drivable pressure bands 11 are continuously led over conveying rollers 21 and 22 fixed on shaft 16 and rotatable on shaft 14. The pressure or tension bands are driven, for instance, by way of a chain wheel 24 fixed on shaft 16; here the shafts 14 and 16 are rotatable in the frame 12. The surface of the pressure strips 11 and of the glide plates 10 as well as the surfaces of the back wall rollers 9 are located in one plane and together define the back wall 7 of the stacking table 5. All elements of the back wall are placed suitably positioned in the frame 12, which also is connected with the machine frame 1.

Two continuous and driven pairs of conveying chains 28 and 30 are arranged in gaps between the elements of the back wall and are guided in the same plane. The pair of chains 30 runs between the pair of chains 28. The chains of the pair of chains 30 are guided over chain wheels 32 which are fixed on shaft 13, over chain wheels (not shown) placed rotatable on shaft 16 and over chain wheels 31 placed rotatable on shaft 14; Besides shaft 14, shafts 13 and 15 also are arranged rotatable in frame 12. The drive of the pair of chains 30 takes place by way of the chain wheel 19 fixed on shaft 13.

The chains of the pair of chains 28 run over the chain wheels 18 rotatable on shafts 13 and 15 and over chain wheels 17 rotatable; and on shaft 14. The drive takes place here by way of the chain wheel 20 rotatable on shaft 14.

The pairs of conveying chains 28 and 30 serve to hold and guide lead transporter and follow-up transporter 25 and 26 respectively, assuring performance of the stacking operation on the stacking table 5. The sheets 27 of the sheet-by-sheet stream are stacked here on the lead transporter 25 running downward onto the stacking table. The follow-up transporter 26 serves to press down stack 23 before the bundling. The lead transporter consists of the two supporting arms 34 which are arranged adjacent to each other and hold a guide plate 35. Each of the supporting arms 34 is fastened on a chain 28 in such a way that they form the desired angle with the chain.

The follow-up transporter 26 has also two supporting arms 33 adjacent to each other which also hold a guard plate 33 and which are each fastened on a chain 30 in the same manner as arms 34.

Figure 6:
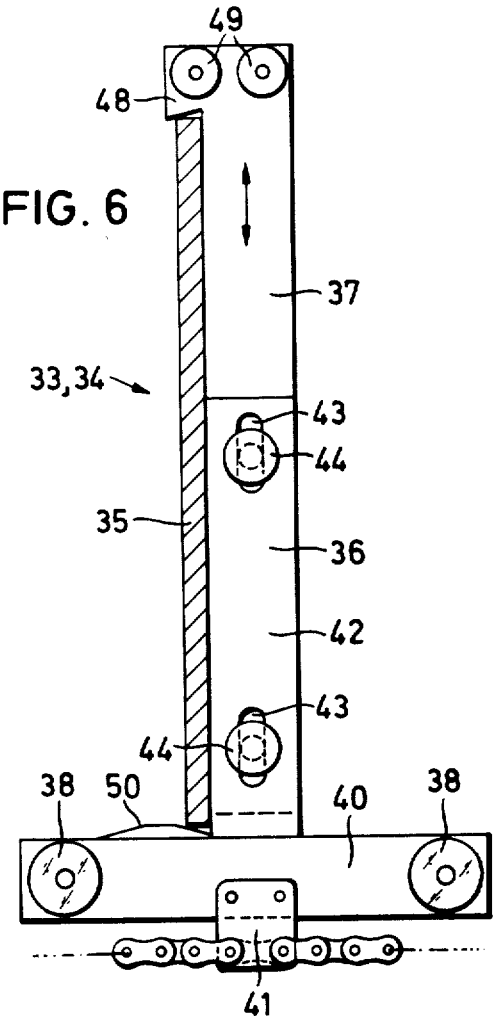
FIG. 6 shows a lateral view of a transporter.
Figure 7:
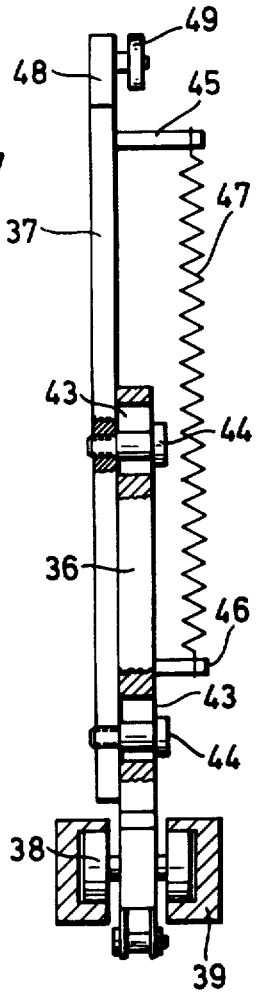
FIG. 7 shows a top view of a transporter.

Each supporting arm 33, 34 (FIG. 6 and 7) viewed laterally consists essentially of a T-shaped guide part 36 and a flat bar 37. The guide part 36 has in the end zone of the crossbar 40 on both sides guide rollers 38 which slide in corresponding guide rails 39 which are arranged especially in the back wall 7 parallel to the chains to prevent the chains from sagging during the stacking and guarantee the preselected angle formed by the supporting arms of the transporter with the surface of the stacking table during the stacking and pressing down. Of course, the rails can be arranged along the entire chain.

In the center of the crossbar 40 there are arranged fitting plates 41 by way of which the supporting arm is firmly connected with the chain. The longitudinal bar 42 of the guide piece 36 has two longitudinal slots 43 following one another. The flat bar 37 is held on the guide piece 36 by screws 44 reaching through the slots 43 in such a way that it can slide back and forth corresponding to the length of the grooves 43. The flat bar 37 is pulled as far as possible in the direction of the T-part 36 by means of spring 47 located on pins 45 and 46.

The flat bar 37 has a clamping nose 48 on its free end and two control rollers 49 on the spring side. A guard plate 33' is held between the clamping nose 40 and a trapezoidal clamping piece 50 on the T-part 36 located opposite the clamping nose by the tensional force of the spring 47 together with the inclined surfaces of the nose 48 and of the clamping piece 50. The supporting arms 34 of the lead transporter 25 are arranged on the chain in such a way that the clamping nose 48 points in a direction opposite to the conveying direction so that the guard plate 33' rests on the arms during the stacking. The arms of the follow-up transporter 26 are attached on the chain in an exactly reversed manner, namely, rotated around the longitudinal axis by 180° so that the clamping noses 48 thereof point in the conveying direction whereby the clamped-in guard plate 33' hangs below the arms during the pressing down of the stack.

According to a special embodiment of the invention, plates 35 are put automatically in the supporting arms of the transporters. The plates 35 function as transporter plates 25 or guard plates 26 depending upon whether they are positioned on arms 34 or 33, respectively. For this purpose there is provided a plate magazine system 6 which is placed on carrying bars 51 in the machine frame. System 6 includes a plate magazine 52, a slide 55, a hold-down device 56 which is arranged before the magazine and, with a piston cylinder system 88, is rotatable around a shaft 88'. System 6 also includes curved pieces 57 and 58 arranged in front of the hold-down element and a lifter 59, which consists of a piston cylinder unit, below and between the rails 54. The magazine is arranged inclined and with its lateral surfaces, is aligned parallel to the rear chain strand 60 so that the rails 54 are at a right angle to the chain strand 60 or at an angle corresponding to the angle of inclination of the transporters 25 and 26.

Figure 5A:
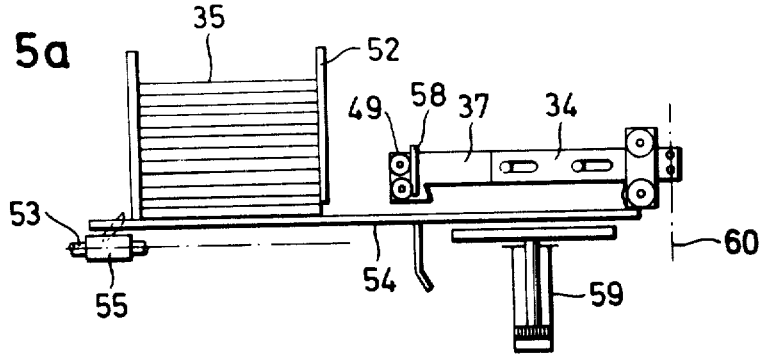
FIG. 5*a* shows the function of the guard plate for the lead transporter.
Figure 5B:
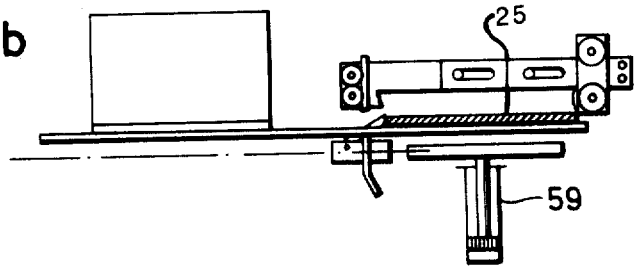
FIGS. 5*b*, 5*c* and 5*d* showing following stages.
Figure 5C:
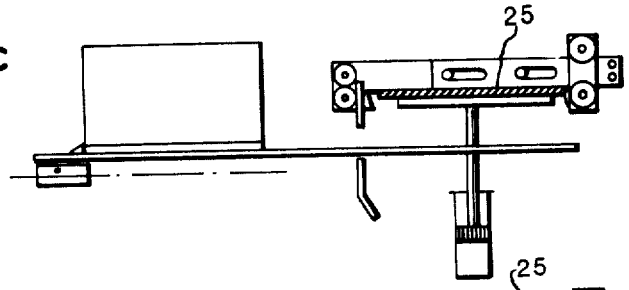
Figure 5D:
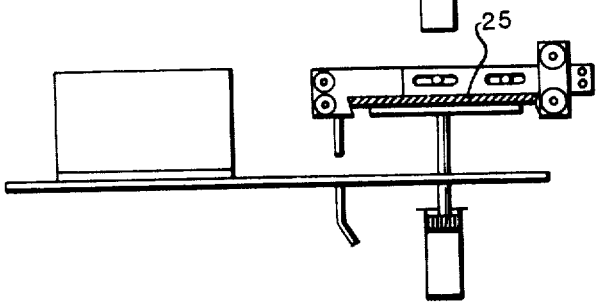

For loading a lead transporter 25 (FIG. 5*a*) with a plate 35, the slide 55 moves a plate 35 over the rails 54 in the direction of the chain strand 60 after the supporting arms 34 have passed the rails (FIG. 5*b*). The control rollers 49 slide here over the curved pieces 57 and 58, and the flat bar 37 is pulled outward against the tension of the spring. At the same time, the piston of the lifter 59 moves out faster than the chain 28 runs and pushes the plate 35, which was moved forward, under the supporting arms (FIG. 5*c*) until the control rollers 49 reach the end of the curved piece 58 and subsequently the flat bar 37 is pulled back into its initial position while the plate 35 is clamped in and is taken along by the supporting arms (FIG. 5*d*). Subsequently, the piston of the lifter 59 and the slide 55 move back again.

Figure 4A:
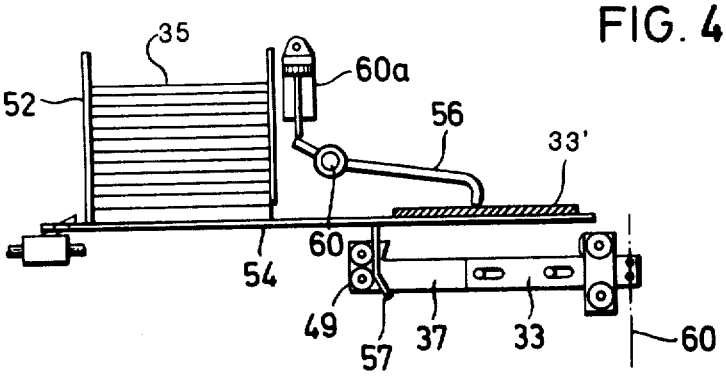
FIG. 4*a* shows the function of the guard plate feed for the follow-up transporters.
Figure 4B:
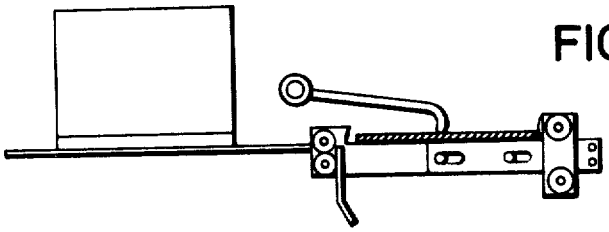
FIGS. 4*b* and 4*c* showing stages.
Figure 4C:
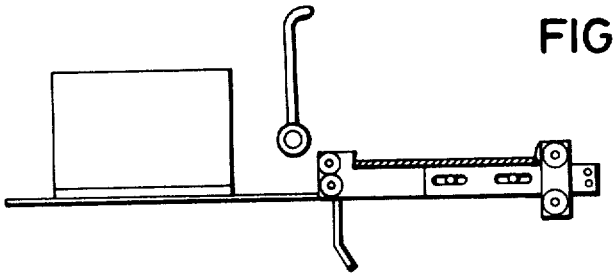

The loading of the lead transporter 26 (FIG. 4*a*) takes place in such a way that the slide 55 pushes forward a plate 35 before the supporting arms 33 reach the rails 54 (FIG. 4*a*). The hold-down element 56 is swung onto the plate 35 and presses it firmly onto rails 54 so that the plate rests optimally on it. In this case, the control rollers 49 are deflected from the single curved piece 57 while the flat bar 37 also is pulled outward (FIG. 4*b*). When passing the rails 54, the plate 35, which was pushed forward, is taken along (FIG. 4*b*), the rollers 49 slide off the guide piece, the flat bar 37 slips back into its initial position and plate 35 is clamped in by it. Simultaneously, the hold-down device is swung back (FIG. 4*c*). The clamping system of the transporters as described herein enabled the use as guard plates of small boards as guard plates requiring little accuracy of measurement. Devices hitherto known required small boards with especially true measurements—a fact which made bundling considerably more expensive because the small boards were frequently slightly damaged during further processing of the bundles and therefore had to be removed from the operation. Now, only considerably damaged boards need be discarded.

Another advantage of the invention is that bundling is enabled on the stacking table without moving the stack in the transverse direction. For this purpose, a banding system 61 known per se is provided behind the back wall 7 of the stacking table 5; its work table 62 (shown only in outline) is fastened behind and parallel to the back wall 7 in the machine frame 1 and its cross frames 63 reach through the center gap of the stacking table at a distance. It is important that an angular piece 65 of the upper cross frame 63 be arranged so that it can be withdrawn on shaft 66. Thereby an opening, through which the stack 29 can move unimpeded, is created in the frame. By these strikingly simple means, it is possible to perform bundling at the stacking place.

Figure 2:
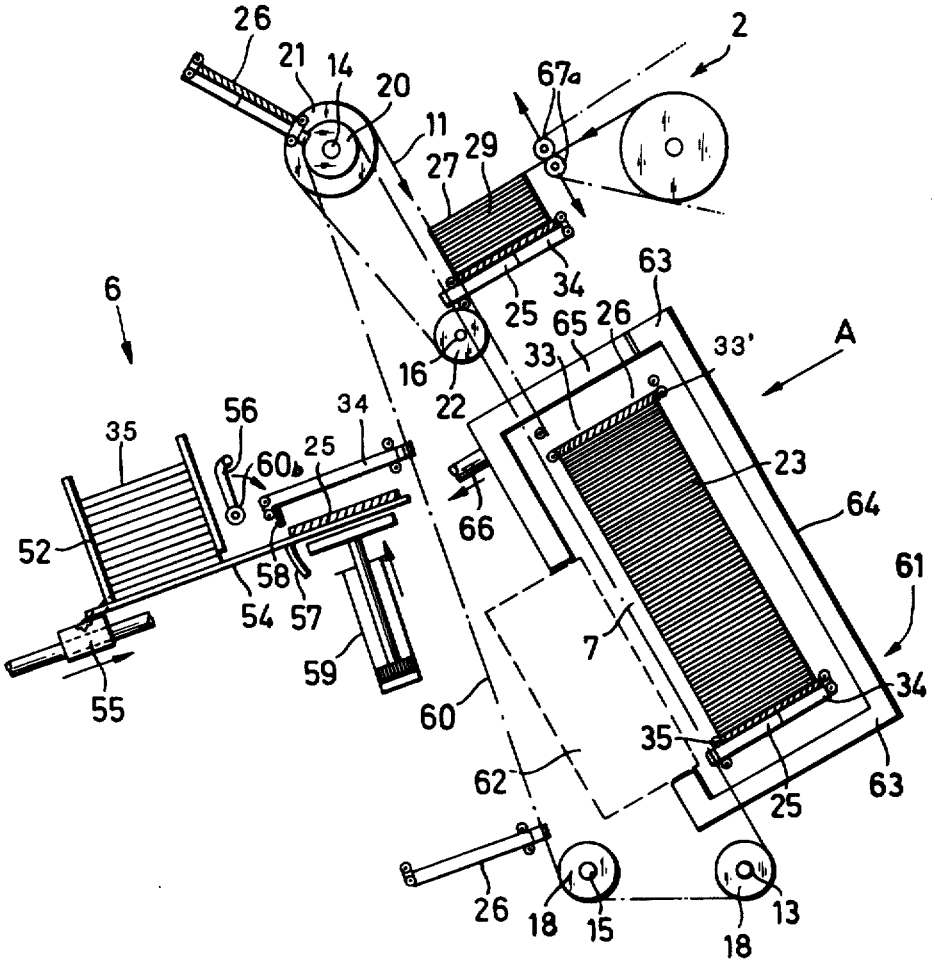
FIG. 2 shows a lateral view of the stacking table with the feeding station for the guard plates.

The means of conveyance 2 are conveying elements known per se and are arranged in the machine frame 1 in s suitable manner. However, it is new and especially advantageous that, by swinging the conveying rollers 67 up and down in coordination with the change of the speed of the lead transporter 25, the angle of impact of sheets 27 can be changed. In FIG. 2, there is shown, for instance, an angle of impact of 0, whereas the angle of FIG. 1 is about 10°.

The automatic bundling machine as defined in the invention has also a brake 4 for the sheet-by-sheet stream in order to form a gap or an accumulation, respectively, in the sheet-by-sheet stream. Sheet-by-sheet stream brakes are known per se, and generally consist of an automatically operated lever arm which, by means of a nose, reaches in front of the edge of a sheet in the sheet-to-sheet stream and thereby holds back that sheet and the following ones. However, these brakes have the disadvantage that the sheet preceding below the edge of the first stopped sheet is pushed onto the conveyor belt in an uncontrollable manner. Furthermore, the thickness of the overlapping sheet-by-sheet stream is increased during the accumulation and this disturbs the even conveying after the stoppage is cancelled.

Figure 8:
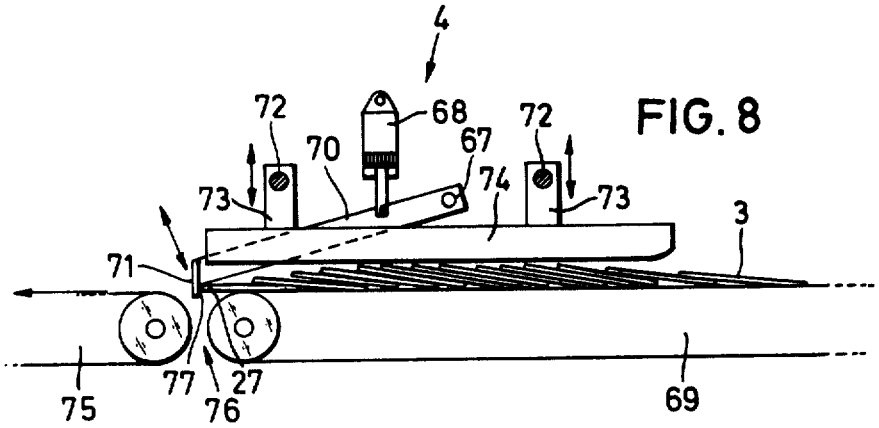
FIG. 8 shows a lateral view of the brake for the overlapping sheet-by-sheet stream.

The sheet-by-sheet stream brake provided herein avoids these disadvantages with the device, as defined in the invention, by the fact that the nose is swung into the gap between two conveyor belts and simultaneously at least one hold-down bar of a suitable length is pressed onto the sheet-by-sheet stream behind the nose. The sheet-by-sheet stream brake 4 as defined in the invention and shown in FIG. 8 is placed in the machine frame 1 and comprises brake lever arm 70 which, with the piston cylinder system 68, is pivotally mounted on the shaft 67 and arranged in the center over the conveyor belt 69. The free end of arm 70 carries a brake nose 71 which protrudes downward. Laterally in the longitudinal direction, parallel and next to the brake lever arm 70 and also above the conveyor belt 69, there are arranged two hold-down bars 74 which are laterally adjustable on shafts 72 and which can move upward and downward with holders 73. Spaced forward of conveyor belt 69, there is another conveyor belt 75. The brake lever arm 70 is arranged so that nose 71 points into the gap 76 when the lever arm is swung downward for braking. The sheets (not shown), which lie below the edge 77 of the first sheet 27 of the stopped sheet-by-sheet stream 3, can withdraw into the gap 76 when the nose is pushed down and are taken along by the preceding sheet-by-sheet stream without deformation. At the same time, the sheet-by-sheet stream 3 does not bulge, or does so only slightly, during further conveying of the belt 69 below the hold-down bars 74 which are pressed onto the sheet-by-sheet stream by means of the lever arm 70. The system as defined in the invention works faultlessly with this effective sheet-by-sheet stream brake. One can possibly do without the deflector 78 which is known per se.

The mode of operation of the device as defined in the invention is essentially as follows: The sheet-by-sheet stream 3 is conveyed by conveyor belts in a manner known per se. The stream can be interrupted by means of a brake 4 and can be divided into columns. In the event the stream 3 contains waste paper to be discarded such can be separated automatically by means of the conveyor belt portion which comprises a swingable deflector 78. In the phantom line position illustrated in FIG. 1 the deflector 78 discharges waste paper onto the floor. After passing the deflector, the sheet-by-sheet stream 3 is conveyed upward by means of upper and lower belts as well as guide rollers of the conveying means 2 at an angle of inclination of preferably 60°, and then again downward to the point of impact on the stacking table by way of another guide roller. The first sheet of a column is pushed onto the guard plate of a lead transporter 25 until it hits against the back wall 7 of the stacking table 5. Thus it covers the last part of the way without contact with the means of conveyance. U.S. Pat. No. 3,822,793, July 9, 1974, is exemplary of the aforedescribed structure for such sheet-by-sheet feed. All following sheets of the column are put down into a stack on the transporter which slides downward. The pressure bands 11, which are in contact with the folded edges of the sheets and run somewhat faster than the lead transporter, press the edges down in such a way that a stack shaped like a rectangular building block results. Without the pressure bands, the stack would not be like a rectangular block because an oblique stack surface could arise in connection with thick sheets that have a significant difference in thickness with respect to the folded edge as opposed to the unfolded edge. When the last sheet lies on the stack 29, the follow-up transporter 26 runs toward the stack, places itself with the guard plate on the stack and presses it down upon the stack. This is achieved by the fact that the follow-up transporter 26 runs at a linear speed faster than the lead transporter.

When the stack 29 has arrived close to the bottom 8 of the stacking table 5, the angular piece 65 is moved against the cross frame 63 of the banding system 61 and thereby the entire frame is closed. Subsequently the compressed stack is bundled into a bundle by means of a band. Subsequently the bundle reaches the bottom 8 while the lead transporter 25 releases the plate 35 and runs on. This takes place in a manner equivalent to the loading of the transporter and therefore is not illustrated separately. Shortly before, the follow-up transporter 26 also has released the plate and has remained behind or run back part of the way. Afterwards, the bundle 23 by means of the cooperatively driven rollers 9 and 9' is moved transversely. For conveying, the frame of the banding system 61 is opened and the empty transporters are again supplied with guard plates.

The device as defined in the invention is built very compact. By the special construction of the transporters together with the loading system and its special arrangement in relation to the stacking table, the possibility exists of stacking with means of conveyance, free of friction, by jogging against a stacking table inclined in the conveying direction, of pressing down the folds at the place of stacking, of pressing of the stack and of banding it in order to form a bundle, the bundle has here a plate on top and at the bottom. The sheet-by-sheet stream brake system 4 assures against deformation of the sheet-by-sheet stream columns.

The device as defined in the invention can be varied with respect to the format to a considerable extent and is insensitive to the fluctuations in the quality of the sheets. It can likewise be used for bulky voluminous book papers and labile intaglio papers. In this connection, the angle of inclination of the transporters to the stacking table can be changed according to a special characteristic. By the separate drive of the transporters, the device as defined in the invention can be changed easily to shorter or longer lengths of the bundles. Furthermore, the pressing force of the stack can be accurately adjusted.

With the device as defined in the invention, it is especially favorable that the speed of the lead transporters can be controlled automatically, for instance, by a capacity transmitter (sender), whereby independence of the fluctuations in the thickness of the paper is achieved, and that the length of the stack can be changed by simple adjustment means.

FIG. 9, schematically shows the principle of the pressing of the relatively thick folded edges of the sheets, i.e., signatures, as defined in the invention to assure a rectangular stack. The toothed wheel 78 rotates in the direction of the arrow and receives a layer 80 in the tooth gap 79 and leads said layer downward onto the stack 23, which moves downward. The stack is pressed downward at the same time by the teeth 81 of the toothed wheels 78. Of course, several toothed wheels next to each other or a wide toothed wheel roller can be used. Moreover, laterally of the stacking table 5, toothed wheels 78 with slanted toothing can be used, whose teeth 81 are inclined toward the back wall 7 of the stacking table and thereby bring about guiding and pressing not only downward but also in a horizontal direction or in a direction inclined toward the horizontal. The method as defined in the invention is, of course, not only applicable for the production of inclined stacks but can also be used with devices stacking vertically and horizontally.

FIG. 10 shows the arrangement of the toothed wheels at the stacking table 1 in connection with the pressure band system.

For pressing, the toothed wheels are arranged at the upper end of the stacking table so as to act upon the edges of the sheets as they are fed to their respective transporter plate 25 as the aforedescribed sheet-by-sheet stream. Their placing is not separately illustrated. The toothed wheels 82 are here in the folding zone, the toothed wheels 83 are on the top side and the bottom side, and the toothed wheels 84 are on the open side of the sheets.

By means of the invention it has been possible to easily ensure the rectangular box like configured stack. The illustrated arrangement of the toothed wheels is an example and can be varied. In any case, the use of toothed wheels has been advantageous because they guide at the edges of the layers and simultaneously press in grating-like fashion because of the protrusion of the teeth as shown in FIG. 10.

What we claim is:

1. A device for producing a bundle from an overlapping sheet by sheet stream of paper sheets according to a method wherein the sheets are serially free fall delivered to a downwardly moving inclined base while the sheets are continuously jogged and pressed as the stack is being formed, the serial free fall delivery of the sheets being interrupted after a predetermined number of delivered sheets and the compressing being effected by moving a compressor downwardly against the top of the stack at a rate faster than the stack is moving and the compressed stack is banded to form the bundle, said device comprising: a machine frame, a stacking table within said frame, said stacking table having means defining an inclined back wall for supporting the stack and base plate means arranged vertically relative to the plane of said defined back wall for receiving the free-fall delivered sheets, feed means carried by said machine frame for free-fall delivering a sheet by sheet stream to said stacking table, circulating conveying means carried by said machine frame, said base plate means carried on said circulating conveying means, means for pressing the formed stack also carried by said circulating conveying means, and means for separating the formed stacks one from the next following stack, said inclined back wall including stop face means for receiving the sheets in abutting relationship therewith at the terminus of their free fall; said circulating conveyor means comprising first and second circulating conveyors, said first circulating conveyor carrying said base plate means, and said pressing means comprising follow-up transporter plate means carried by said second circulating conveyor along a common path as the base plate means and substantially parallel thereto and drive means for moving said second circulating conveyor faster than said first circulating conveyor to bring the follow-up transporter plate means against the top of the stack carried by the base plate means during the movement of the base plate means.

2. The device as claimed in claim 1 wherein said defined back wall is inclined about 60° toward the vertical, said base plate means being angularly arranged relative to the back wall; and means for selectively changing the angular position of said back wall means relative to the base plate means.

3. The device as claimed in claim 2 and said stacking table being inclined adjacent grate-like and parallel drivable rollers.

4. The device as claimed in claim 3 and first and second shaft means rotatably mounted to said machine frame, first and second drive means coupled to said first and second shaft means respectively, said first and second conveyor means being coupled to said shaft means respectively to define generally coplanar reaches including a first reach proximate and parallel to said back wall and a second reach spaced from said back wall, guard plate feed means adjacent said second reach, said common path being along said reaches, said base plate means and said follow-up transporter plate means comprise first and second transporters adapted to receive and guard plates delivered thereto from said guard plate feed means, said plates being carried to said first reach, said first transporter with said guard plate thereon receiving said sheets from said sheet feed means successively during travel along said first reach whereby a stack of said sheets is built up thereon.

5. The device as claimed in claim 4 and glide plate means arranged stationary and aligned upward in extension of said back wall rollers; drivable endless pressure band means aligned with said glide plate means, and conveying rollers rotatably mounted on said first shaft means, third shaft means also carrying conveying rollers fixedly mounted thereto and said endless pressure band means carried by said conveying rollers.

6. The device as claimed in claim 5 and said second transporter, with the guard plate thereon, adapted to engage upon the stack subsequent to the last sheet of the stack being fed thereto.

7. The device as claimed in claim 4, said first and second conveyors each comprise a spaced endless chain pair, supporting roller means mounted on said first and second shaft means respectively, the supporting roller means for said first conveyor mounted between the supporting roller means for said second conveyor.

8. The device as claimed in claim 5 wherein said third shaft means rotatably mounted to said machine frame between said first and second shaft means, third drive means coupled to said third shaft means for independently driving same, and said endless pressure band means includes plural spaced endless pressure bands mounted upon said support rollers arranged spaced along said first and third shaft means and drivable by said third drive means and third drive means coupled to drive said support rollers.

9. The device as claimed in claim 5 in which said pressure band means define a third reach coincident with the leading edge of the stack and capable of jogging said sheets of the stack as they travel along said first reach seated on said first transporter.

10. The device as claimed in claim 7 in which said endless conveyor supporting rollers are located between said endless pressure band support rollers.

11. The device as claimed in claim 5 in which the endless pressure band means are spaced vertically from said back wall to define a gap and glide plate means are disposed in said gap to bridge same in alignment with said back wall rollers thereof.

12. The device as claimed in claim 5 in which said first and second transporters comprises a pair of coplanar supporting arms arranged spaced apart and holding means on said arms for supporting a guard plate therebetween, means on said arms for coupling same to said respective circulating conveyor means to define an angle therebetween.

13. The device as claimed in claim 10 in which each supporting arm comprises a first guide part having a T-shaped configuration defined by a first bar portion and a cross bar at one end of said first bar portion and a second part defined by a flat bar at the opposite end of said first bar portion, guide roller means mounted to the opposite ends of the cross bar, guide rail means arranged in said back wall adjacent said first and second reaches and adapted to receive said guide roller means therein, slot means formed in said first bar portion and screw means secured through said slot means to said flat bar, whereby to effect a slidable connection with said first bar portion, pin means secured onto said first bar portion and said flat bar, spring means fastened between said first bar portion and onto said pin means and said flat bar whereby to bias said flat bar toward said first bar portion, and clamp means on said flat bar and first bar portion capable of engaging said guard plate as to hold same therebetween.

14. The device as claimed in claim 13 in which said clamp means comprise an inclined surface on one of said flat bar and first bar portion.

15. The device as claimed in claim 13 in which said clamp means comprise an inclined clamping nose on one of said flat bar and said first bar portion and a trapezoidal clamping part on the other of said flat bar and said first bar portion and opposite said clamping nose, said guard plate being capable of being held therebetween.

16. The device as claimed in claim 13 and at least the first reach of said first conveyor means being parallel with the first reach of said second conveyor means.

17. The device as claimed in claim 13 wherein the first reaches are coincident with the leading edge of said sheets and said guard plate feeding means is positioned arranged proximate to said second reaches and said inclined back wall.

18. The device as claimed in claim 4 in which said first transporter is capable of receiving a guard plate from said guard plate feeding means for supporting successive sheets fed thereto along said first reach, said second transporter operable to receive guard plates from said guard plate feeding means and are capable of placing a guard plate upon the moving accumulation of sheets defining the stack as the same travels along said first reach.

19. The device as claimed in claim 5 in which said transporters each comprise a T-shaped pair of supporting arms, each supporting arm comprising a T-shaped guide portion having a cross-bar first flat bar portion, a second flat bar portion coupled to said first flat bar portion as an extension thereof, guide roller means mounted at the free ends of said cross bar portion, guide rail means arranged in said back wall and parallel to said endless conveyor.

20. The device as claimed in claim 15 in which the first and second transporter means each have a nose carried thereby and said nose has an inclined surface directed in a direction opposite the direction of conveyance, and the inclined nose carried by the second transporter has an inclined surface directed in a direction the same as the conveying direction.

21. The device as claimed in claim 5 and means for mounting said guard plate feed means on the machine frame, said guard plate feed means comprising a guard plate magazine and a delivery end including a pair of lateral bottom rails, a shaft, a slide movably mounted on said shaft between said lateral magazine rails, a second shaft, hold-down means arranged in the vicinity of the delivery end and having a piston cylinder arrangement being rotatably mounted about said second shaft, curved members arranged at the hold-down means and lift means including a piston-cylinder unit disposed below and between said rails for placing a guard plate between the clamping means carried by said first transporter.

22. The device as claimed in claim 4 in which there is a banding station assembly disposed within said machine frame and behind said back wall.

23. The device as claimed in claim 4 in which said conveying rollers forming stacking tables are arranged for swingable movement vertically.

24. The device as claimed in claim 4 in which said conveying rollers are adjustable with respect to the size of said sheets.

25. The device as claimed in claim 4 in which said sheet feed means delivers an overlapping sheet by sheet stream.

26. The device as claimed in claim 25 and brake means disposed within said machine frame, said brake means comprising a brake lever arm, a piston cylinder arrangement coupled to said brake lever arm and a shaft, means rotatably coupling said lever arm and piston cylinder arrangement about said shaft for rotation therearound, said brake being arranged over the center of the sheet conveyor means, and a brake nose on the free end of said brake lever arm, said conveying means including a pair of belts having a gap therebetween and said brake nose being arranged to protrude in the path of said sheets and within said gap to intercept said sheet stream.

27. A device as claimed in claim 26 with a hold down bar mounted to said shaft for lateral adjustment relative to said shaft for lateral adjustment relative to said conveying belts.

28. The device as claimed in claim 26 wherein the banding station is withdrawable from said machine.

29. The device as claimed in claim 4 wherein the sheets are folded and means for pressing at least one of said folds, said open sheet side, the top side and the bottom side of the sheets of the stack moving along said first reach and at least one pressing device having tooth elements arranged to open in the direction of said stack.

30. The device as defined in claim 29 and at least one driven toothed wheel arranged at the upper end of the stacking table in the stacking zone and having a gap between its teeth capable of receiving the leading edges of a sheet for guiding the sheet downward onto the stack as the stack moves along said first reach and further capable of engaging the stack to press same in the direction of movement of the transporter means, said toothed wheel having slanted toothing whose teeth are inclined toward said back wall.

31. The device as claimed in claim 30 in which the base of the tooth rim is arranged tangentially to an edge of the stack and that the teeth protrude in the direction of the stack.

32. The device as claimed in claim 30 wherein paper sheets are folded and the toothed wheels are disposed at least at one of the folds, the top and bottom sides and in which the toothed wheels are disposed on the open side of the folded sheets.

33. The device as claimed in claim 30 wherein said toothed wheel is in the form of a rotating brush.

34. The device as claimed in claim 30 and said toothed wheel is in the form of a roller having a smooth, elastic surface, the tooth elements thereat are formed only by the contact pressure during the pressing.

35. The device as claimed in claim 30 wherein the paper sheets are folded and means for pressing at least one of the folded edges, the open edge, the top side and the bottom side of said folded sheets of the stack during the downward motion of the inclined back wall.

36. The device as claimed in claim 1 and a tension band system is provided for pressing the sheets in the stack downward.

37. The device according to claim 1 wherein the back wall and the base plate means have drivable rollers arranged grate-like and parallel adjacent each other.

38. The device according to claim 37 wherein glide plates are positioned stationary and aligned upward in extension of the back wall rollers glide plates being followed by the bands of the tension band system being equally aligned.

39. The device as claimed in claim 1 wherein said pressing means further includes at least one rotating piece having radial tooth elements for pressing down the edges of the sheets on one side of the stack.

40. The device as claimed in claim 39 wherein the rotating piece includes toothed wheels, said wheels having a helical gearing, the teeth of which are inclined toward the back wall of the stacking table.

41. The device as claimed in claim 40 wherein said pressing means includes a roller having a smooth, elastic surface, the tooth elements being formed only by the counter pressure while being pressed.

42. The device as claimed in claim 1 and a banding device proximate said stacking table, said banding device having a guide channel for banding material, the channel having a retractable upper portion.

43. The device as claimed in claim 1 wherein the sheet-by-sheet stream is fed at an angle of about 70° to 90° relative to the conveying direction and the inclined plate.

44. The device as claimed in claim 1 wherein said pressing means includes a tension band system integrated into the stacking table, the sheet-by-sheet stream consists of folded sheets, said tension band system operates at the folded edges of the sheets.

45. The device as claimed in claim 1 in which the back wall is inclined toward the vertical by 10° to 60° in the conveying direction.

* * * * *